US011724278B2

(12) United States Patent
Shen et al.

(10) Patent No.: US 11,724,278 B2
(45) Date of Patent: Aug. 15, 2023

(54) OUTPOURING ASSEMBLY

(71) Applicant: ZHENGZHOU SANHUA TECHNOLOGY & INDUSTRY CO., LTD., Henan (CN)

(72) Inventors: Ruhua Shen, Henan (CN); Kunkun Zhang, Henan (CN)

(73) Assignee: ZHENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 514 days.

(21) Appl. No.: 16/821,805

(22) Filed: Mar. 17, 2020

(65) Prior Publication Data

US 2020/0289997 A1 Sep. 17, 2020

(30) Foreign Application Priority Data

Mar. 17, 2019 (CN) ..... 201910200775.6
Mar. 17, 2019 (CN) ..... 201910200778.X
Mar. 17, 2019 (CN) ..... 201910200779.4

(51) Int. Cl.
*B05B 15/50* (2018.01)
*B05B 15/522* (2018.01)
(Continued)

(52) U.S. Cl.
CPC ..... *B05B 15/5225* (2018.02); *B01F 33/84* (2022.01); *B01F 33/841* (2022.01); *B01F 35/121* (2022.01); *B01F 35/7547* (2022.01); *B05B 12/06* (2013.01); *B65B 39/004* (2013.01); *B01F 2101/30* (2022.01)

(58) Field of Classification Search
CPC ..... B05B 15/5225; B05B 12/06; B01F 33/84; B01F 33/841; B01F 35/121; B01F 35/7547; B01F 2101/30; B65B 39/004
See application file for complete search history.

(56) References Cited

U.S. PATENT DOCUMENTS 2,923,438 A * 2/1960 Logan ..... B01F 35/3231 222/2
3,851,798 A * 12/1974 Miller ..... B05B 15/5225 222/149

(Continued)

FOREIGN PATENT DOCUMENTS

CN 105026307 11/2015

*Primary Examiner* — Nicolas A Arnett
(74) *Attorney, Agent, or Firm* — Hamre, Schumann, Mueller & Larson, P.C.

(57) ABSTRACT

An outpouring assembly, comprising an outpouring plate, wherein the outpouring plate is provided with a liquid outlet through hole, a paste discharge pipe is disposed in the liquid outlet through hole, the paste discharge pipe moves up and down in the liquid outlet through hole, and when a lower end of the paste discharge pipe extends out of the liquid outlet through hole, the paste discharge pipe is in a liquid outpouring state. A beneficial effect of the present invention is as follows: Because a liquid such as the color paste or water has surface tension, the color paste adheres to a surface of an outlet, outpouring precision of the outpouring assembly is affected. A paste discharge pipe is disposed in the liquid outlet through hole, so that a quantity of color pastes adhered to a paste discharge outlet of the paste discharge pipe can be effectively reduced.

17 Claims, 6 Drawing Sheets

(51) Int. Cl.

| | |
|---|---|
| ***B01F 33/841*** | (2022.01) |
| ***B01F 35/12*** | (2022.01) |
| ***B01F 35/75*** | (2022.01) |
| ***B05B 12/06*** | (2006.01) |
| ***B65B 39/00*** | (2006.01) |
| ***B01F 33/84*** | (2022.01) |
| *B01F 101/30* | (2022.01) |

(56) References Cited

U.S. PATENT DOCUMENTS

| | | | | |
|---|---|---|---|---|
| 5,725,032 | A * | 3/1998 | Oshima | G02F 1/1341 141/31 |
| 7,070,318 | B2 * | 7/2006 | Renfro | B01F 27/88 366/331 |
| 7,105,202 | B2 * | 9/2006 | Okamoto | B05D 7/222 427/398.1 |
| 7,407,321 | B1 * | 8/2008 | Renfro | B01F 35/30 366/256 |
| 8,413,847 | B2 * | 4/2013 | Miller | B01F 25/50 239/113 |
| 8,666,540 | B2 * | 3/2014 | Milhorn | B01F 29/20 700/239 |
| 10,221,839 | B2 * | 3/2019 | Huang | F04B 9/111 |
| 10,378,523 | B2 * | 8/2019 | Li | F04B 1/29 |
| 10,894,238 | B2 * | 1/2021 | Singh | B01F 27/806 |
| 11,021,008 | B2 * | 6/2021 | Zhang | B44D 3/003 |
| 2011/0290823 | A1 * | 12/2011 | Miller | B05B 15/58 239/113 |
| 2016/0327035 | A1 * | 11/2016 | Shen | F04B 1/124 |
| 2020/0246767 | A1 * | 8/2020 | Shen | B01F 33/84 |
| 2020/0289997 | A1 * | 9/2020 | Shen | B05B 15/5225 |
| 2020/0377248 | A1 * | 12/2020 | Drocco | B65B 39/004 |

* cited by examiner

OUTPOURING ASSEMBLY

FIELD OF TECHNOLOGY

The present invention belongs to the coating color mixing field, and specifically, to a backflow outpouring assembly.

BACKGROUND

A color mixer is a commonly used device in the coating field, and is used to take and mix different coatings according to a requirement to obtain a required coating, such as emulsion paint. There are multiple assemblies in the color mixer for outpouring a color paste. The outpouring assemblies include a color paste bucket, a pump body, and the like, and outpour a color paste through a paste discharge channel or a paste discharge nozzle. The outpouring assemblies are arranged on the color mixer in a plurality of manners. Generally, the plurality of outpouring assemblies are arranged in a straight line or in a circle. Paste discharge nozzles of the outpouring assemblies arranged in a circle may be concentrated in one range, and are suitable for an automatic color mixing mechanism that simultaneously outpours at least two color pastes. There are also many types of outpouring assemblies, including a backflow outpouring assembly with a drying prevention function and the like. The patent CN105026307B of ALLOCATION VALVE ASSEMBLY AND COLOR PASTE ALLOCATION APPARATUS FOR COLOR MIXER provides a backflow outpouring assembly and a color paste allocation apparatus. However, some problems still exist. Because of tension of a liquid such as a color paste, the liquid is easily adsorbed at a paste outlet of a paste discharge channel of the outpouring assembly, thereby reducing outpouring precision of the color paste. A residual color paste needs to be cleaned up after the color paste is outpoured. An existing outpouring assembly and a structure of a cleaning mechanism cause insufficient cleaning.

SUMMARY

The present invention provides a backflow outpouring assembly that facilitates cleaning of a residual color paste and an increase in precision.

An outpouring assembly, comprising an outpouring plate, wherein the outpouring plate is provided with a liquid outlet through hole, a paste discharge pipe is disposed in the liquid outlet through hole, the paste discharge pipe moves up and down in the liquid outlet through hole, and when a lower end of the paste discharge pipe extends out of the liquid outlet through hole, the paste discharge pipe is in a liquid outpouring state.

A thickness of a wall of a lower end surface of the paste discharge pipe is less than 1 millimeter; or the paste discharge pipe is a thin-wall pipe, and a thickness of the thin-wall pipe is less than 1 millimeter; or a thickness of a wall of a lower end of the paste discharge pipe gradually decreases from top to bottom.

The paste discharge pipe moves up and down in the liquid outlet through hole means that the paste discharge pipe is subjected to downward force to extend downwards and is subjected to upward force to retract.

An oscillating rod rotatably disposed on the outpouring plate, wherein an upper limiting stopper and a lower limiting stopper are disposed on the paste discharge pipe, and an end A of the oscillating rod is located between the upper limiting stopper and the lower limiting stopper; or a lower limiting stopper is located on the paste discharge pipe, an end A of the oscillating rod is located above the lower limiting stopper, and a spring is disposed between the paste discharge pipe and the outpouring plate.

A first valve member, wherein the first valve member comprises at least one backflow channel, and relative movement is performed between the first valve member and the outpouring plate, so that the outpouring assembly performs switching between an outpouring location and a backflow location; and further comprising a mounting bracket, wherein a first linear drive mechanism is disposed on the mounting bracket, and a mobile end of the first linear drive mechanism is fixedly connected to the outpouring plate, to enable the outpouring plate to move; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

The outpouring assembly is a backflow outpouring assembly, the backflow outpouring assembly further comprises a first valve member, the first valve member comprises at least one backflow channel, and relative movement is performed between the first valve member and the outpouring plate, so that the backflow outpouring assembly performs switching between an outpouring location and a backflow location.

A contact surface between the first valve member and the outpouring plate are slope surfaces.

Relative movement is performed between the first valve member and the outpouring plate, so that the backflow outpouring assembly performs switching between an outpouring location and a backflow location means that the outpouring plate horizontally moves, and that the first valve member and the outpouring plate coordinately move up and down, so that the two remain in contact through the contact surface.

The backflow outpouring assembly further comprises a mounting bracket, a horizontal rail pair is disposed on the mounting bracket, a sliding block of the horizontal rail pair is fixedly connected to a mobile apparatus, the mobile apparatus comprises a mobile bracket, and a lead screw mechanism is disposed on the mobile bracket; the lead screw mechanism comprises a screw and a nut; the screw is rotatably disposed on the mobile bracket, and in a moving direction of the mobile bracket, the contact surface between the outpouring plate and the first valve member is parallel to an axis of the screw; the nut is disposed in a limiting groove of the mounting bracket in a manner of sliding up and down; the limiting groove limits horizontal movement of the nut; the nut is fixedly connected to the first valve member.

A lower portion of the first valve member is elastically connected to a compression sliding block, and the compression sliding block and a second rail on the mobile bracket constitute a second rail pair; an axis of the second rail is parallel to the axis of the screw.

A location sensor or a stroke switch for determining a moving distance of the outpouring plate is disposed between the outpouring plate and the first valve member.

A paste discharge pipe is disposed in the liquid outlet through hole, the paste discharge pipe moves up and down in the liquid outlet through hole, and when a lower end of the paste discharge pipe extends out of the through hole, the paste discharge pipe is in a liquid outpouring state; that the paste discharge pipe moves up and down in the liquid outlet through hole means that the paste discharge pipe is subjected to downward force to extend downwards and is subjected to upward force to retract.

A paste discharge pipe is disposed in the liquid outlet through hole, the paste discharge pipe moves up and down in the liquid outlet through hole, and when a lower end of the paste discharge pipe extends out of the through hole, the paste discharge pipe is in a liquid outpouring state; that the paste discharge pipe moves up and down in the liquid outlet through hole means that the paste discharge pipe is subjected to downward force to extend downwards and is subjected to upward force to retract.

An oscillating rod rotatably disposed on the outpouring plate, wherein an upper limiting stopper and a lower limiting stopper are disposed on the paste discharge pipe, and an end A of the oscillating rod is located between the upper limiting stopper and the lower limiting stopper; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

An oscillating rod rotatably disposed on the outpouring plate, wherein a lower limiting stopper is disposed on the paste discharge pipe, an end A of the oscillating rod is located above the lower limiting stopper, and a spring is disposed between the paste discharge pipe and the outpouring plate; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

A sealing mechanism is disposed between the liquid outlet through hole and the paste discharge pipe.

A beneficial effect of the present invention is as follows: A contact surface between a first valve member and an outpouring plate is a plane, in other words, an axis or a length direction of a liquid outlet through hole is perpendicular to the contact surface. In such a structure, it is inconvenient to clean a residual color paste after a color paste is outpoured. In the present invention, the contact surface between the first valve member and the outpouring plate is set to a slope plane. There is an included angle between the axis or the length direction of the liquid outlet through hole and the contact surface. In such a structure, it is easier for the residual color paste to gather downwards at a cleaning location, facilitating cleaning by a cleaning tool.

Because a liquid such as the color paste or water has surface tension, the color paste adheres to a surface of an outlet. The outpouring plate is in a planar state in most cases, and when the color paste is directly outpoured from the liquid outlet through hole, relatively many color pastes adhere to the outlet of the liquid outlet through hole, thereby affecting a quantity of outpoured color pastes. In this case, outpouring precision of the outpouring assembly is affected. A paste discharge pipe is disposed in the liquid outlet through hole, so that a quantity of color pastes adhered to a paste discharge outlet of the paste discharge pipe can be effectively reduced.

1 indicates a rack, 11 indicates a base, 12 indicates outlet space, 2 indicates a backflow outpouring assembly, 20 indicates an outpouring plate, 200 indicates a backflow through hole, 201 indicates a liquid outlet through hole, 21 indicates a backflow pipe, 22 indicates a paste discharge pipe, 220 indicates an upper limiting stopper, 221 indicates a lower limiting stopper, 23 indicates a sealing mechanism, 24 indicates an oscillating rod, 25 indicates a spring, 26 indicates a first valve member, 260 indicates a backflow channel, 27 indicates a cleaning groove, 3 indicates a mounting bracket, 30 indicates a horizontal strip-shaped groove, 31 indicates a limiting groove, 4 indicates a horizontal rail pair, 40 indicates a sliding block, 5 indicates a mobile bracket, 50 indicates a screw, 51 indicates a nut, 52 indicates a first motor, 53 indicates a second rail, 54 indicates a sensor, 6 indicates a compression sliding block, 60 indicates a guiding column, 61 indicates a compression spring, 7 indicates a cleaning mechanism, 70 indicates a brush, 71 indicates a mounting plate, 72 indicates an upper support arm, 73 indicates a lower mounting plate, 74 indicates a lower support arm, 75 indicates a second lead screw mechanism, 76 indicates a linear telescopic mechanism, 77 indicates an engaged tooth, and 78 indicates a plurality of sections of sleeves.

DESCRIPTION OF THE EMBODIMENTS

Figure 1:
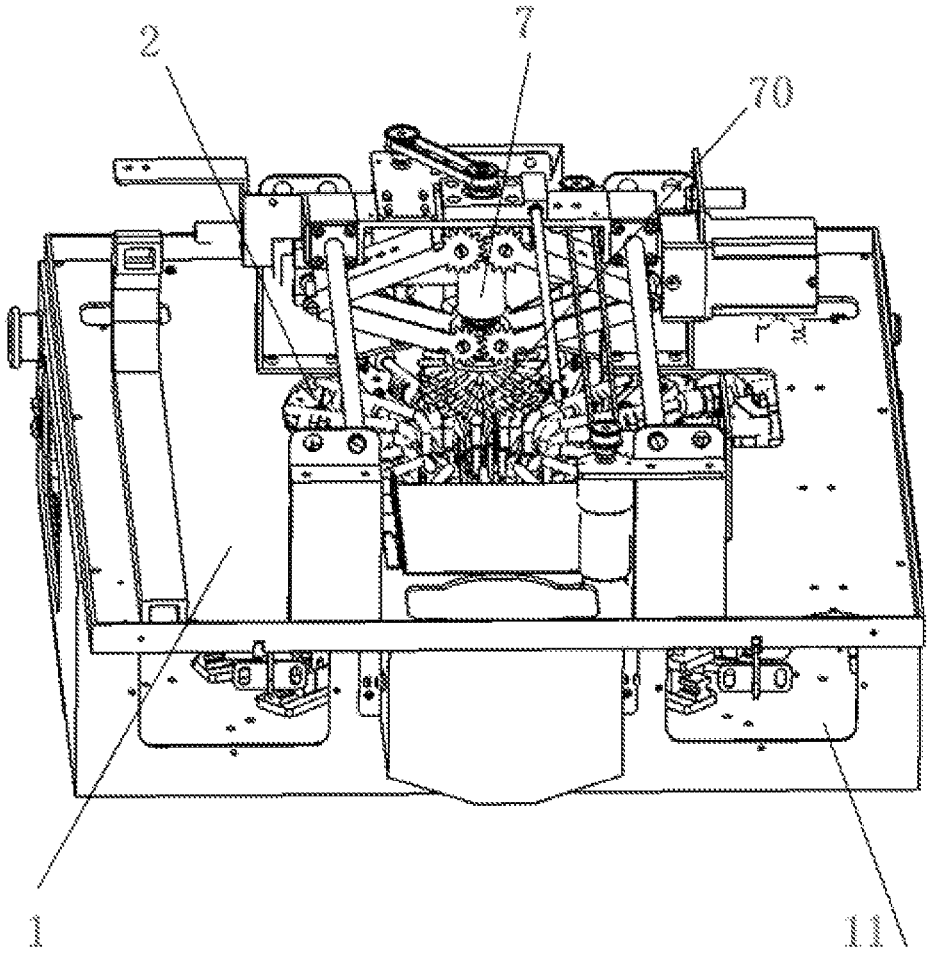
FIG. 1 is a schematic diagram of distribution of outpouring assemblies in a color mixer and a cleaning mechanism.
Figure 2:
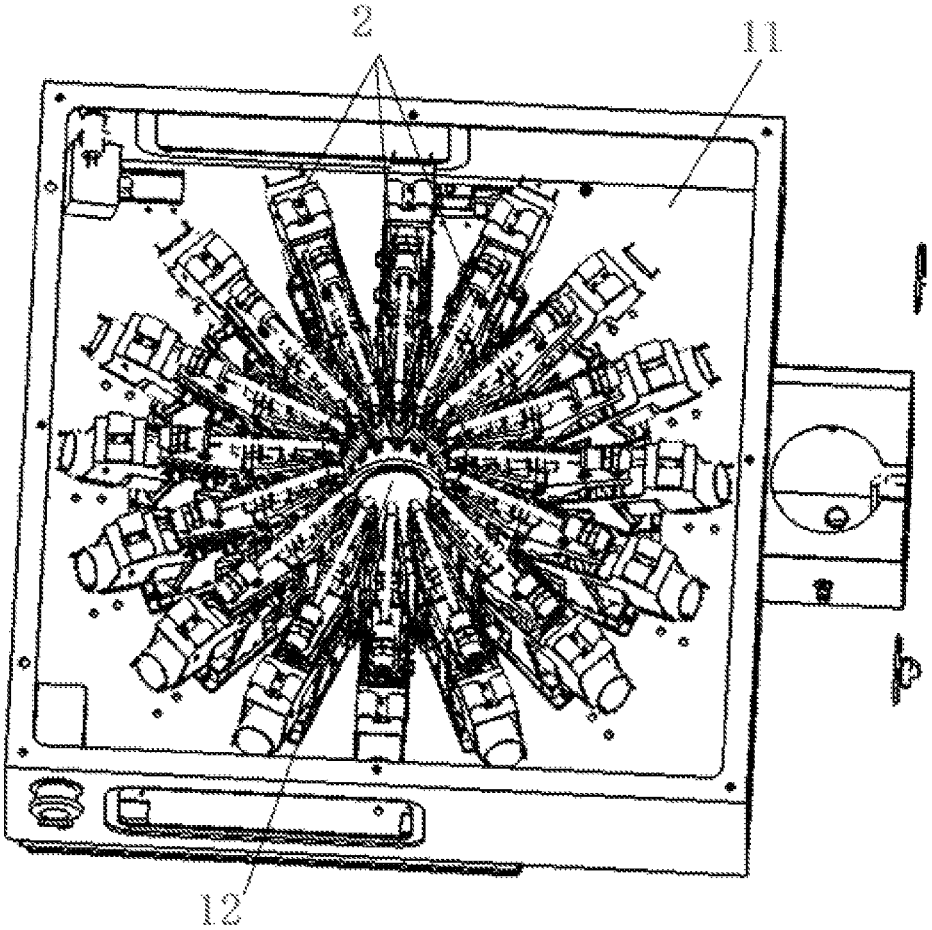
FIG. 2 is a diagram of circumferential distribution of outpouring assemblies in a color mixer.
Figure 3:
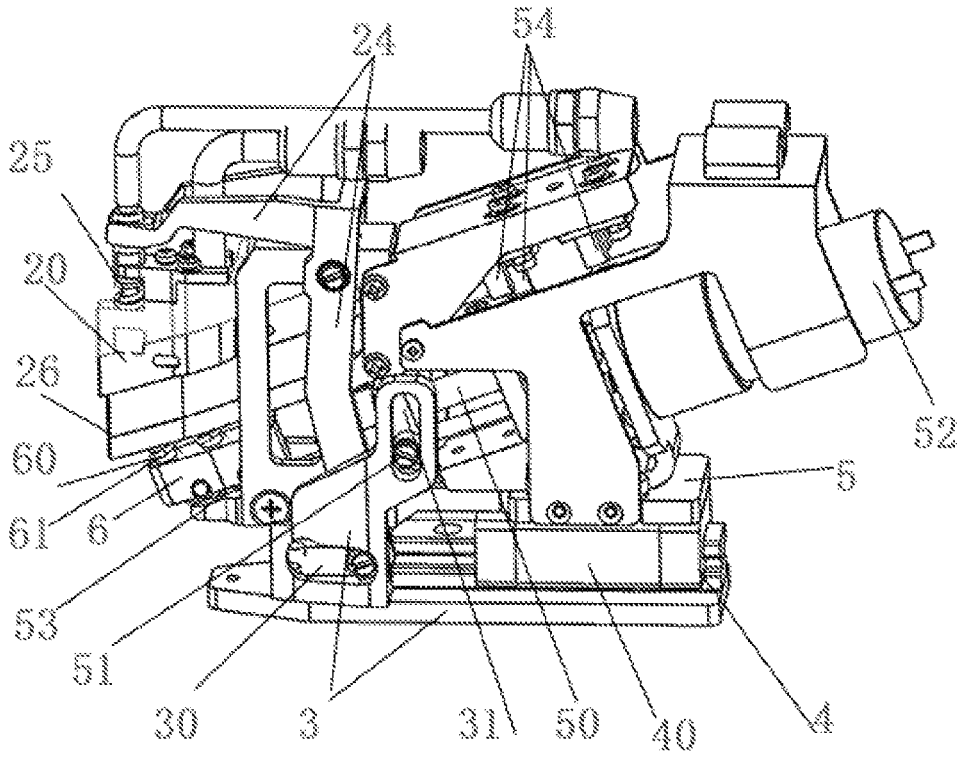
FIG. 3 is a schematic diagram of a backflow outpouring assembly.
Figure 4:
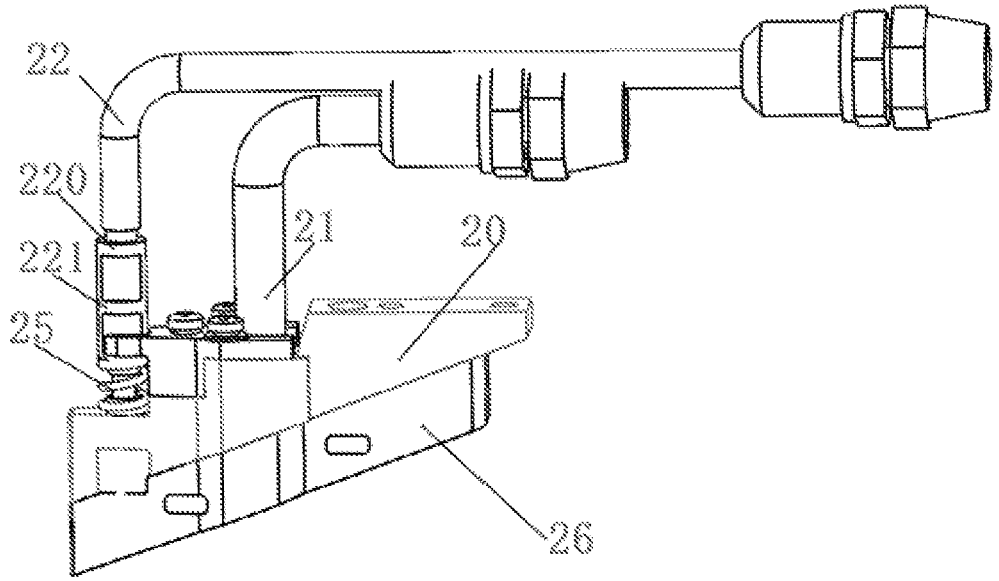
FIG. 4 is a schematic diagram of an outpouring plate.
Figure 5:
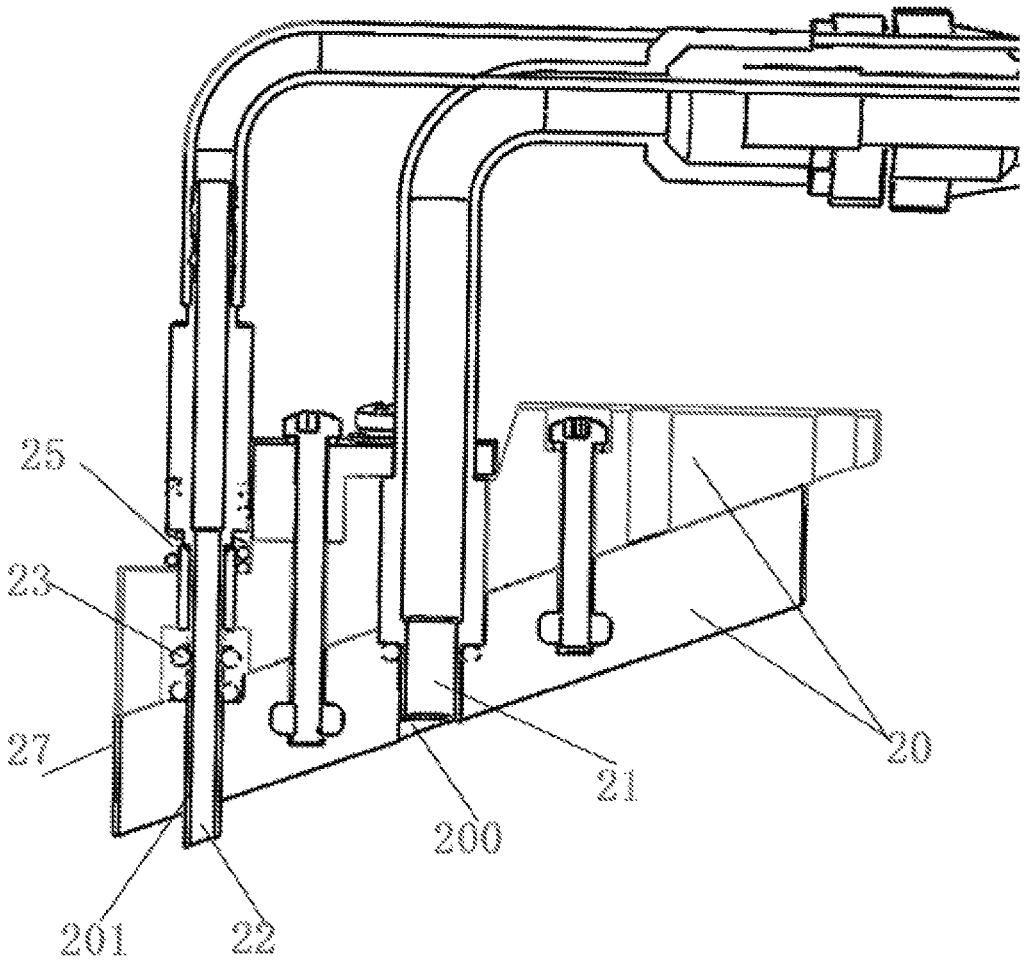
FIG. 5 is a section view of FIG. 4.
Figure 6:
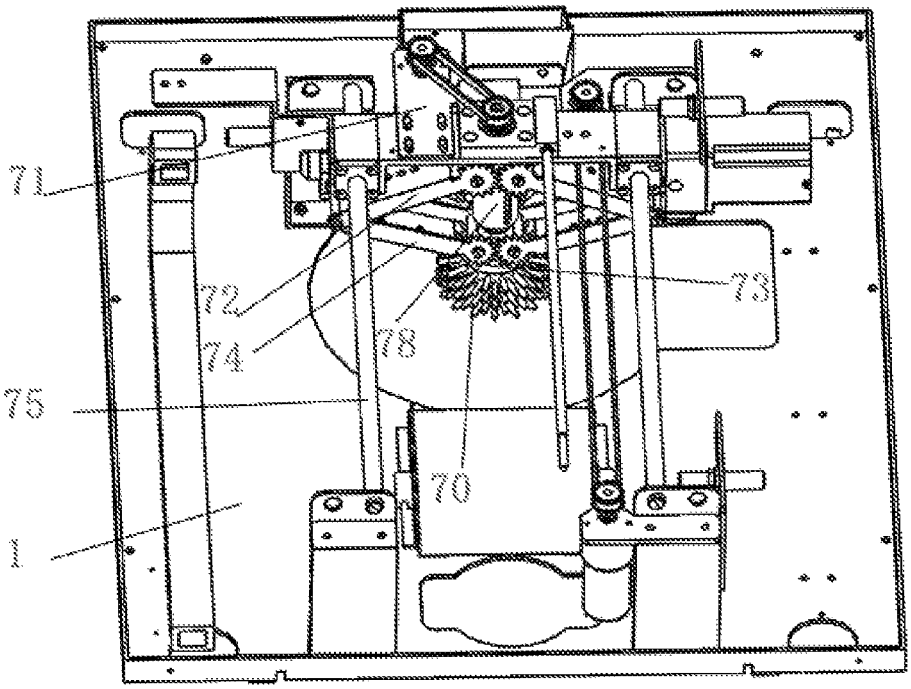
FIG. 6 is a schematic diagram of a cleaning mechanism.
Figure 7:
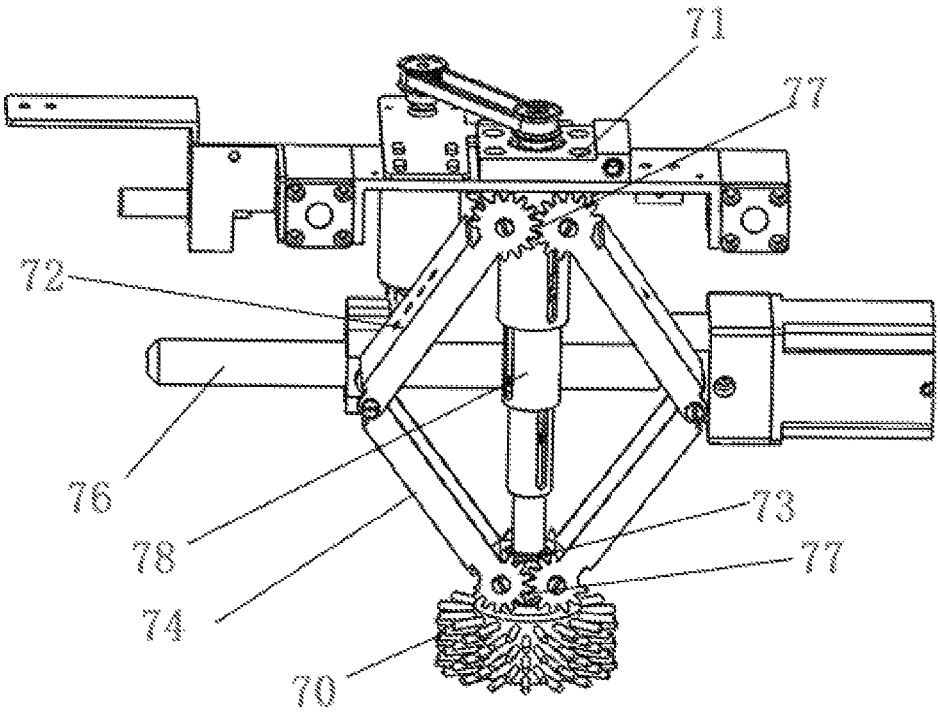
FIG. 7 is a schematic diagram of an elevating mechanism in an extended state.
Figure 8:
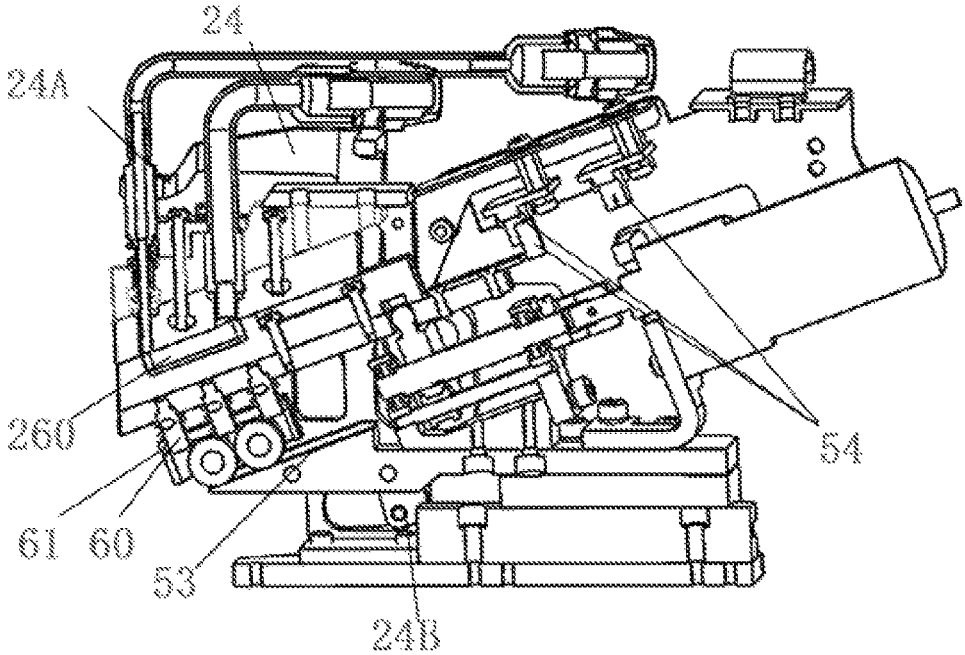
FIG. 8 is a section view of FIG. 3.
Figure 9:
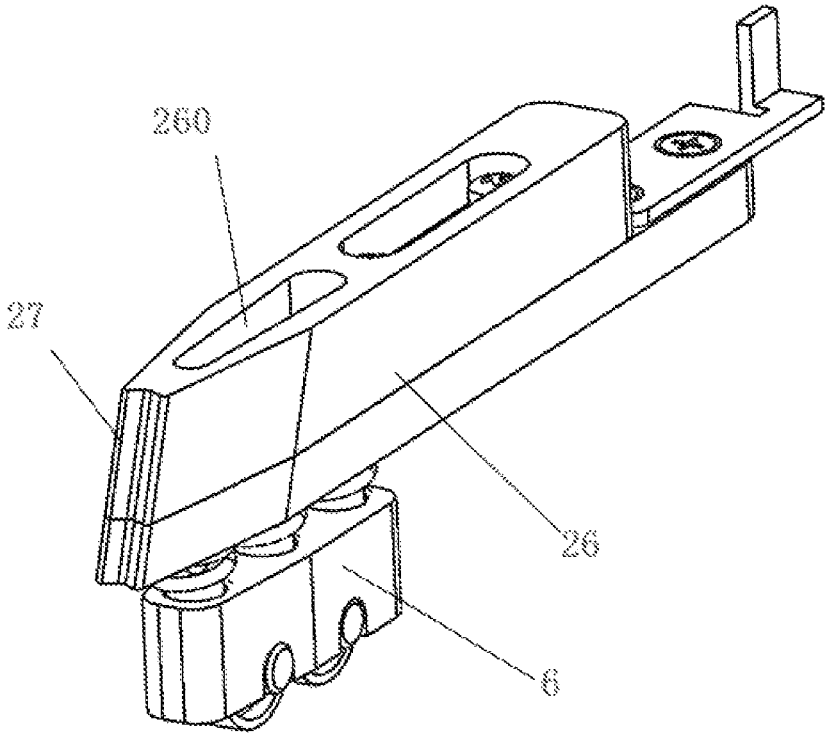
FIG. 9 is a schematic diagram of a first valve member, where

As shown in FIG. 1 to FIG. 9, an outpouring assembly is provided, including an outpouring plate 20. The outpouring plate 20 is provided with a liquid outlet through hole 201, a paste discharge pipe 22 is disposed in the liquid outlet through hole 201, the paste discharge pipe 22 moves up and down in the liquid outlet through hole 201, and when a lower end of the paste discharge pipe 22 extends out of the liquid outlet through hole 201, the paste discharge pipe 22 is in a liquid outpouring state. The paste discharge pipe 22 herein communicates with a color paste pump by using a pump body. Because a liquid such as the color paste or water has surface tension, the color paste adheres to a surface of an outlet. The outpouring plate 20 is in a planar state in most cases, and when the color paste is directly outpoured from the liquid outlet through hole 201, relatively many color pastes adhere to the outlet of the liquid outlet through hole 201, thereby affecting a quantity of outpoured color pastes. In this case, outpouring precision of the outpouring assembly is affected. The paste discharge pipe 22 is disposed in the liquid outlet through hole 201, so that a quantity of color pastes adhered to the paste discharge outlet of the paste discharge pipe can be effectively reduced.

A thickness of a wall of a lower end surface of the paste discharge pipe 22 is less than 1 millimeter. With a same inner diameter of paste discharge outlets of the paste discharge pipe 22, a smaller wall thickness leads to higher precision. The thickness of the wall may be preferably 0.5 millimeter or lower. Alternatively, the paste discharge pipe 22 is a thin-wall pipe, and the thickness of the thin-wall pipe is less than 1 millimeter. Alternatively, the thickness of the wall at a lower end of the paste discharge pipe 22 gradually decreases from top to bottom. The thickness of the end surface, in other words, the thickness of the wall at the paste discharge outlet, is less than 1 millimeter. A sealing mechanism 23 is disposed between the liquid outlet through hole 201 and the paste discharge pipe 22. A sealing ring may be selected as the sealing mechanism 23.

That the paste discharge pipe 22 moves up and down in the liquid outlet through hole 201 means that the paste discharge pipe 22 is subjected to downward force to extend downwards and is subjected to upward force to retract. A specific structure may be as follows: The outpouring assembly further includes an oscillating rod 24 rotatably disposed on the outpouring plate 20. An upper limiting stopper 220 and a lower limiting stopper 221 are disposed on the paste discharge pipe 22, and an end A of the oscillating rod 24 is located between the upper limiting stopper 20 and the lower limiting stopper 221. When the end A of the oscillating rod 24 rotates downwards, the end A of the oscillating rod 24 pushes the lower limiting stopper 221 and the paste discharge pipe 22 to move downwards together. When the oscillating rod 24 rotates upwards, the end A of the oscillating rod 24 pushes the upper limiting stopper 220 and the paste discharge pipe 22 to move upwards together. A power source needs to be provided to the oscillating rod 24 to enable the oscillating rod to rotate. A common mechanism may be used as a power source for oscillation. The oscillating rod 24 may be set to a shape of "7" or another shape according to an actual case. The upper limiting stopper 220 and the lower limiting stopper 221 are located above the outpouring plate 20, in other words, on a side far away from a contact surface between the outpouring plate 20 and the first valve member 26.

Alternatively, the outpouring assembly further includes an oscillating rod 24 rotatably disposed on the outpouring plate 20. The paste discharge pipe 22 is located above the outpouring plate 20, a lower limiting stopper 221 is disposed above the paste discharge pipe 22, an end A of the oscillating rod is located above the lower limiting stopper 221, and a spring 25 is disposed between the paste discharge pipe and the outpouring plate 20. When the end A of the oscillating rod 24 rotates downwards, the end A of the oscillating rod pushes the lower limiting stopper 221 and the paste discharge pipe 22 to move downwards together. When the end A of the oscillating rod 24 rotates upwards, resilience force of the spring 25 provides the paste discharge pipe with upward force. The spring 25 may also be added to the previous embodiment. However, the spring 25 in the previous embodiment makes a cushioning effect.

To prevent a color paste from drying in a channel or at an outpouring outlet, an outpouring assembly having a backflow function may be used, in other words, a backflow outpouring assembly 2. The backflow outpouring assembly 2 further includes a first valve member 26, the first valve member 26 includes at least one backflow channel 260, and relative movement is performed between the first valve member 26 and the outpouring plate 20, so that the backflow outpouring assembly 2 performs switching between an outpouring location and a backflow location. The contact surface between the first valve member 26 and the outpouring plate 20 is preferably a plane. A backflow through hole 200 is further provided on the outpouring plate 20, and a backflow pipe 21 is disposed in the backflow through hole 200. At the backflow location, the liquid outlet through hole 201, the backflow channel 260, the backflow through hole 200 communicate with each other. Certainly, there are other backflow manners and other required structures, as shown in the patent CN105026307B. These are existing technologies, and are not described in detail again.

The outpouring assembly may further include a mounting bracket 3. A first linear drive mechanism is disposed on the mounting bracket 3, and a mobile end of the first linear drive mechanism is fixedly connected to the outpouring plate 20, to enable the outpouring plate 20 to move. An end B of the oscillating rod 24 is disposed in a horizontal strip-shaped groove 30 of the mounting bracket 3, and a stroke of horizontal movement of the outpouring plate 20 is greater than a horizontal length of the horizontal strip-shaped groove 30. A shape of the horizontal strip-shaped groove 30 correspondingly coordinates with an oscillation margin of the oscillating rod 24.

In addition, the existing backflow outpouring assembly 2 includes the first valve member 26 and the outpouring plate 20. The outpouring plate 20 includes at least one liquid outlet through hole 201, the first valve member 26 includes at least one backflow channel 260, and relative movement is performed between the first valve member 26 and the outpouring plate, so that the backflow outpouring assembly performs switching between an outpouring location and a backflow location. A contact surface between the first valve member 26 and an outpouring plate 20 is a plane, in other words, an axis or a length direction of the liquid outlet through hole 201 is perpendicular to the contact surface. In such a structure, it is inconvenient to clean a residual color paste after a color paste is outpoured. In the present invention, the contact surface between the first valve member 26 and the outpouring plate 20 may be set to a slope plane. There is an included angle between the axis or the length direction of the liquid outlet through hole 201 and the contact surface. In such a structure, it is easier for the residual color paste to gather downwards at a cleaning location, facilitating cleaning by a cleaning tool.

That relative movement is performed between the first valve member 26 and the outpouring plate 20, so that the backflow outpouring assembly 2 performs switching between an outpouring location and a backflow location means that the outpouring plate 20 horizontally moves, and that the first valve member 26 and the outpouring plate 20 coordinately move up and down, so that the two remain in contact through the contact surface. The outpouring plate 20 and the first valve member 26 are slope. When the outpouring plate 20 horizontally moves, the first valve member 26 needs to move up and down to ensure that the outpouring plate 20 is always in contact with the first valve member 26.

The backflow outpouring assembly 2 further includes a mounting bracket 3, a horizontal rail pair 4 is disposed on the mounting bracket 3, a sliding block 40 of the horizontal rail pair is fixedly connected to a mobile apparatus, the mobile apparatus includes a mobile bracket 5, and a lead screw mechanism is disposed on the mobile bracket 5. The lead screw mechanism includes a screw 50 and a nut 51. The screw 50 is rotatably disposed on the mobile bracket 5, and in a moving direction of the mobile bracket, the contact surface between the outpouring plate 20 and the first valve member 26 is parallel to an axis of the screw 50. The nut 51 is disposed in a limiting groove 31 of the mounting bracket 3 in a manner of sliding up and down. The limiting groove 31 limits horizontal movement of the nut 51. The nut 51 is fixedly connected to the first valve member 26. The screw 50 of the lead screw mechanism is rotatably disposed on the mobile bracket 5 by using a bearing. The screw 50 is driven by a first motor 52 for rotation. The first motor 52 may be a servo motor. The limiting groove 31 is perpendicular to a moving direction of the mobile bracket 5, and the nut 51 linearly moves in the limiting groove 31. A line of intersection, with the contact surface between the outpouring plate 20 and the first valve member 26, of a plane in which the axis of the screw 50 and the moving direction of the mobile bracket 5 are located is parallel to the axis of the screw 50. The screw 50 is slope, and the sliding block 40 fixed on the screw 50 can linearly move only in a horizontal direction. Therefore, the screw 50 moves horizontally and linearly while rotating, to drive the outpouring plate 20 to move, and the nut 51 moves up and down to drive the first valve member 26 to move.

A lower portion of the first valve member 26 is elastically connected to a compression sliding block 6, and the compression sliding block 6 and a second rail 53 on the mobile bracket 5 constitute a second rail pair. An axis of the second rail 53 is parallel to the axis of the screw 50. The first valve member 26 and the compression sliding block 6 are provided with a guiding hole, a removable guiding column 60 is disposed in the guiding hole, and a compression spring 61 is disposed out of the guiding column 60 located between the first valve member 26 and the compression sliding block 6. A rolling wheel is rotatably disposed below the compression sliding block 6, and the rolling wheel slides in a guiding groove of the second rail 53, so that the compression sliding block 6 rolls on the second rail 53. The rolling wheel herein may directly use a bearing. The compression sliding block may enable elastic compression to be performed between the first valve member 26 and the outpouring plate 20.

A location sensor 54 or a stroke switch for determining a moving distance of the outpouring plate is disposed between the outpouring plate 20 and the first valve member 26. For example, transmit ends or receive ends of two location sensors are disposed on the mobile bracket 5 along a straight line parallel to the axis of the screw 50, and a tail end of the first valve member 26 is connected to the other end of the location sensor 54, so as to determine a relative moving distance between the outpouring plate 20 and the first valve member 26.

In addition, the paste discharge pipe 22 moving up and down in the liquid outlet through hole 201 may also be disposed in the liquid outlet through hole 201 of the backflow outpouring assembly 2, as shown in the structure in the embodiment of the outpouring assembly in this application. In other words, when a lower end of the paste discharge pipe 22 extends out of the liquid outlet through hole 201, the paste discharge pipe 22 is in a liquid outpouring state. That the paste discharge pipe 22 moves up and down in the liquid outlet through hole 201 means that the paste discharge pipe 22 is subjected to downward force to extend downwards and is subjected to upward force to retract.

The backflow outpouring assembly 2 further includes an oscillating rod rotatably disposed on the outpouring plate 20. An upper limiting stopper 220 and a lower limiting stopper 221 are disposed on the paste discharge pipe 22, and an end A of the oscillating rod is located between the upper limiting stopper 220 and the lower limiting stopper 221. Alternatively, only a lower limiting stopper 221 needs to be located on the paste discharge pipe 22, an end A of the oscillating rod 24 is located above the lower limiting stopper 221, and a spring 25 is disposed between the paste discharge pipe 22 and the outpouring plate 20. The end A of the oscillating rod 24 is restored upwards by elastic force of the spring 25. In the two structures, an end B of the oscillating rod 24 is disposed in the horizontal strip-shaped groove 30 of the mounting bracket 3, and a stroke of horizontal movement of the outpouring plate 20 is greater than a horizontal length of the horizontal strip-shaped groove 30. A shape of the horizontal strip-shaped groove 30 correspondingly coordinates with an oscillation margin of the oscillating rod 24. Assuming that the outpouring plate 20 moves forward, a liquid discharge channel is opened. In a process in which the outpouring plate 20 moves forward and the first valve member 26 moves upwards, the oscillating rod 24 horizontally moves with the outpouring plate 20. When moving to a foremost end of the horizontal strip-shaped groove 30, the end B of the oscillating rod 24 is clamped by the horizontal strip-shaped groove 30, a part that is of the oscillating rod 24 and that is rotatably connected to the outpouring plate 20 continues moving forward, the end B of the oscillating rod 24 oscillates upwards, and the end A of the oscillating rod 24 oscillates downwards. Certainly, a sealing mechanism is also disposed between the liquid outlet through hole 201 and the paste discharge pipe 22.

The foregoing backflow outpouring assembly 2 may be applied to various color mixers, and is preferably applied to an automatic color mixer that can also perform outpouring. Such an automatic color mixer includes a rack 1, and a color paste allocation unit is disposed on the rack 1. The color paste allocation unit includes a color paste bucket storing a color paste, a pump body communicating with a liquid in the color paste bucket, and the backflow outpouring assembly 2. An outpouring channel of the backflow outpouring assembly 2 is connected to the pump body, and a backflow channel is connected to the color paste bucket. A base 11 is disposed on the color mixer, outlet space 12 for cleaning, paste receiving, and allocation is disposed on the base 11, and a plurality of backflow outpouring assemblies 2 are circumferentially distributed on the base 11 of the color mixer along the outlet space 12. A cleaning groove is disposed on side surfaces of front ends of the outpouring plate 20 and the first valve member 26. A residual color paste enters the cleaning groove 27, and is cleaned by using the cleaning mechanism. The side surface of the front end herein is a side surface of a section close to the outlet space 12. A front end of the horizontal strip-shaped groove 30 also points to one end of the outlet space 12. For other functions of the color mixer, refer to the patent CN105026307B. The backflow outpouring assemblies 2 of such a color mixer are intensively distributed along the outlet space 12. A paint mixing cup for receiving a color paste may be disposed under the outlet space 12. When one or more color pastes are required, the color pastes may be simultaneously outpoured by using the pump body and the paste discharge pipe. The color paste allocation unit may further include several valve bodies, so as to control a quantity of color pastes outpoured through each paste discharge pipe. Each color paste allocation unit may perform outpouring in large quantities, or may perform outpouring in small quantities, or may perform back flowing. Herein, the contact surface between the first valve member 26 and the outpouring plate 20 in the backflow outpouring assembly may be slope or horizontal.

The color mixer requires a dedicated cleaning mechanism 7. A horizontal moving mechanism is disposed on a body of the color mixer, an elevating mechanism is disposed on the horizontal moving mechanism, and a brush 70 rotating around an axis of the brush 70 is disposed on the elevating mechanism. The horizontal moving mechanism may be a common linear mechanism. A second lead screw mechanism 75 driven by a second motor is disposed on the rack 1 of the color mixer, and the elevating mechanism slides on a second screw of the second lead screw mechanism 75. The brush 70 may be a cylindrical brush 70. During cleaning, the brush enters the outlet space 12, and rotates to clean residual color pastes on the side surfaces of the front ends of the first valve member 26 and the outpouring plate 20.

The elevating mechanism includes a mounting plate 71 disposed on the rack. The mounting plate 71 is rotatably connected to two upper support arms 72. An end that is of each of the two upper support arms 72 and that is far away from the mounting plate 71 is connected to one lower support arm 74. Two lower support arms 74 are rotatably connected to a lower mounting plate 73. The lower mounting plate 73 is rotatably connected to the brush 70. A linear telescopic mechanism 76 is disposed between the two upper support arms 72 or the two lower support arms 74, and the linear telescopic mechanism 76 telescopes to drive the lower mounting plate 73 to move up and down. Preferably, the two upper support arms 72 have an equal length, the two lower support arms 74 have an equal length, or the upper support arm 72 and the lower support arm 74 have an equal length, so as to ensure that the brush 70 performs linear motion. The upper support arm 72 is hingedly connected to the mounting plate 71, the lower support arm 74 is hingedly connected to the lower mounting plate 73, and the upper and lower support arms are hingedly connected. The two upper support arms 72 are symmetrically disposed. The linear telescopic mechanism may be an air cylinder mechanism, a lead screw mechanism, or the like. The linear telescopic mechanism 76 is rotatably connected to or hingedly connected to the upper support arm 72 or the lower support arm 74.

That the upper support arm 72 and the lower support arm 74 are hingedly connected is that a lower end of the upper support arm 72 and an upper end of the lower support arm 74 are rotatably disposed on a hinged shaft. Two hinged shafts are respectively connected to a telescoping end and a fixing end of the linear telescopic mechanism 76.

Circumferentially distributed engaged teeth 77 centering on a rotating shaft rotating around the mounting plate 71 of the upper support arm 72 is disposed at an end of two upper support arms 72 that is located on the mounting plate 71, and the engaged teeth 77 of the two upper support arms 72 are mutually engaged and clamped.

Circumferentially distributed engaged teeth 77 centering on a rotating shaft rotating around the mounting plate 73 of the lower support arm 74 is disposed at an end of two lower support arms 74 that is located on the mounting plate 73, and the engaged teeth 77 of the two lower support arms 74 are mutually engaged.

A plurality of sections of telescopic sleeves 78 are rotatably disposed on the mounting plate 71, and the plurality of sections of the sleeves are driven by a drive mechanism to rotate. The plurality of sections of the sleeves include at least two sections of sleeves, adjacent sleeves are slidably connected, and the sleeve herein may be a hollow rod body or of another proper shape. A brush 70 is fixed at a tail end of the plurality of sections of the sleeves. A third motor is disposed on the mounting plate 71, and the third motor drives, by using the drive mechanism, a first section of the sleeves to rotate. No relative movement but only relative rotation occurs between the first section of the sleeves and the mounting plate 71. A second section of the sleeves is slidably disposed in the first section of the sleeves, a third section of the sleeves is slidably disposed in the second section of the sleeves, and the plurality of sections of the sleeves are sequentially disposed. A first sliding groove is disposed on the first section of the sleeves, a first sliding block is disposed at an upper end of the second section of the sleeves, and the first sliding block slides in the first groove. A second sliding groove is disposed on the second section of the sleeves, a second sliding block is disposed on the second section of the sleeves, and the second sliding block slides in the second groove. The final section of the sleeves, in other words, the tail end of the plurality of sections of the sleeves 78, is rotatably connected to the lower mounting plate by using a bearing. The final section of the sleeves is located under the lower mounting plate 73, and is provided with a fixing sleeve that prevents the lower mounting plate 73 from sliding on the sleeves. The brush 70 is fixedly disposed at the tail end of the plurality of sections of the sleeves. Alternatively, the brush 70 is rotatably disposed on the lower mounting plate 73 by using a rotating shaft, and the plurality of sections of the sleeves are fixedly connected to the rotating shaft of the brush 70. Another disposing manner may be used, as long as the brush 70 both can linearly move with the lower mounting plate and can rotate with the plurality of sections of the sleeves 78. The cleaning mechanism in this application may be applied to other types of color mixers, as long as the cleaning mechanism can be used for cleaning a color paste, not necessary the color mixer that simultaneously performs outpouring.

During specific implementation, where one or more color pastes are required, a control system controls a corresponding color paste allocation unit to enable a corresponding backflow outpouring assembly 2 to work, to outpour a corresponding quantity of color pastes. First, the first motor is started, the screw 50 rotates, the mobile bracket 5, the sliding block 40, the screw 50, the first motor 52, the oscillating rod 24, the outpouring plate 20, the second rail 53, and the like moves together to a center of the outlet space, and the nut 51, the first valve member 26, and the compression sliding block 6 moves upwards, so that the liquid outlet through hole 201 of the outpouring plate 20 moves out of the first valve member 26. Motion is continued. The end B of the oscillating rod 24 is blocked after moving to one end that is of the horizontal strip-shaped groove 30 and that is close to the outlet space. The oscillating rod 24 oscillates while moving. The paste discharge pipe 22 extends from the liquid outlet through hole 200 to a predetermined location, in other words, the outpouring location. The pump body of a backflow outpouring mechanism is opened to outpour a color paste. After the outpouring is completed, the first motor 52 moves in a reverse direction, the paste discharge pipe 22 retracts back to the liquid outlet through hole 200, and the first valve member 26 and the outpouring plate 20 reversely move to the backflow location. In this case, a residual color paste enters the cleaning groove 27.

The cleaning mechanism 7 starts cleaning, the second lead screw mechanism 75 is started, and the elevating mechanism moves until the brush 70 moves to a location above of the outlet space 12. The linear telescopic mechanism 76 retracts, the two upper support arms 72 and the two lower support arms 74 are separately closed, the lower mounting plate 73 moves downwards to drive the brush 70 to move to space surrounded by the backflow outpouring assemblies 2, and the third motor drives the brush 70 to rotate to clean the residual color paste on the backflow outpouring assembly 2. After the cleaning is completed, the elevation mechanism elevates and moves to an initial location.

Location relationships between the orientations in the above embodiments: above, under, an upper end, a lower end, horizontal, perpendicular, front, and back are relative location relationships, and do not represent the actual up, down, front, and back locations.

The technical features of the foregoing embodiments can be arbitrarily combined. To simplify the descriptions, all possible combinations of the technical features in the above embodiments have not been described. However, as long as there is no contradiction in the combinations of these technical features, it should be considered as the scope described in this specification.

What is claimed is:

1. An outpouring assembly, comprising an outpouring plate, wherein the outpouring plate is provided with a liquid outlet through hole, a paste discharge pipe is disposed in the liquid outlet through hole, the paste discharge pipe moves up and down in the liquid outlet through hole, and when a lower end of the paste discharge pipe extends out of the liquid outlet through hole, the paste discharge pipe is in a liquid outpouring state, wherein a thickness of a wall of the lower end of the paste discharge pipe is equal to or less than 0.5 millimeter.

2. The outpouring assembly according to claim 1, wherein that the paste discharge pipe moves up and down in the liquid outlet through hole means that the paste discharge pipe is subjected to downward force to extend downwards and is subjected to upward force to retract.

3. The outpouring assembly according to claim 1, wherein a sealing mechanism is disposed between the liquid outlet through hole and the paste discharge pipe.

4. The outpouring assembly according to claim 1, wherein the paste discharge pipe is a thin-wall pipe, and a thickness of the thin-wall pipe is equal to or less than 0.5 millimeter.

5. The outpouring assembly according to claim 1, wherein the thickness of the wall of the lower end of the paste discharge pipe gradually decreases from top to bottom.

6. An outpouring assembly, comprising an outpouring plate, wherein the outpouring plate is provided with a liquid outlet through hole, a paste discharge pipe is disposed in the liquid outlet through hole, the paste discharge pipe moves up and down in the liquid outlet through hole, and when a lower end of the paste discharge pipe extends out of the liquid outlet through hole, the paste discharge pipe is in a liquid outpouring state, wherein that the paste discharge pipe moves up and down in the liquid outlet through hole means that the paste discharge pipe is subjected to downward force to extend downwards and is subjected to upward force to retract, wherein the outpouring assembly further comprises an oscillating rod rotatably disposed on the outpouring plate, wherein an upper limiting stopper and a lower limiting stopper are disposed on the paste discharge pipe, and an end A of the oscillating rod is located between the upper limiting stopper and the lower limiting stopper; or a lower limiting stopper is located on the paste discharge pipe, an end A of the oscillating rod is located above the lower limiting stopper, and a spring is disposed between the paste discharge pipe and the outpouring plate.

7. The outpouring assembly according to claim 6, further comprising a first valve member, wherein the first valve member comprises at least one backflow channel, and relative movement is performed between the first valve member and the outpouring plate, so that the outpouring assembly performs switching between an outpouring location and a backflow location; and further comprising a mounting bracket, wherein a first linear drive mechanism is disposed on the mounting bracket, and a mobile end of the first linear drive mechanism is fixedly connected to the outpouring plate, to enable the outpouring plate to move; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

8. An outpouring assembly, comprising an outpouring plate, wherein the outpouring plate is provided with a liquid outlet through hole, a paste discharge pipe is disposed in the liquid outlet through hole, the paste discharge pipe moves up and down in the liquid outlet through hole, and when a lower end of the paste discharge pipe extends out of the liquid outlet through hole, the paste discharge pipe is in a liquid outpouring state, wherein the outpouring assembly is a backflow outpouring assembly, the backflow outpouring assembly further comprises a first valve member, the first valve member comprises at least one backflow channel, and relative movement is performed between the first valve member and the outpouring plate, so that the backflow outpouring assembly performs switching between an outpouring location and a backflow location.

9. The outpouring assembly according to claim 8, wherein a contact surface between the first valve member and the outpouring plate are slope surfaces.

10. The outpouring assembly according to claim 9, wherein a paste discharge pipe is disposed in the liquid outlet through hole, the paste discharge pipe moves up and down in the liquid outlet through hole, and when a lower end of the paste discharge pipe extends out of the through hole, the paste discharge pipe is in a liquid outpouring state; that the paste discharge pipe moves up and down in the liquid outlet through hole means that the paste discharge pipe is subjected to downward force to extend downwards and is subjected to upward force to retract.

11. The outpouring assembly according to claim 8, wherein that relative movement is performed between the first valve member and the outpouring plate, so that the backflow outpouring assembly performs switching between an outpouring location and a backflow location means that the outpouring plate horizontally moves, and that the first valve member and the outpouring plate coordinately move up and down, so that the two remain in contact through the contact surface.

12. The outpouring assembly according to claim 11, wherein the backflow outpouring assembly further comprises a mounting bracket, a horizontal rail pair is disposed on the mounting bracket, a sliding block of the horizontal rail pair is fixedly connected to a mobile apparatus, the mobile apparatus comprises a mobile bracket, and a lead screw mechanism is disposed on the mobile bracket; the lead screw mechanism comprises a screw and a nut; the screw is rotatably disposed on the mobile bracket, and in a moving direction of the mobile bracket, the contact surface between the outpouring plate and the first valve member is parallel to an axis of the screw; the nut is disposed in a limiting groove of the mounting bracket in a manner of sliding up and down; the limiting groove limits horizontal movement of the nut; the nut is fixedly connected to the first valve member.

13. The outpouring assembly according to claim 12, wherein a lower portion of the first valve member is elastically connected to a compression sliding block, and the compression sliding block and a second rail on the mobile bracket constitute a second rail pair; an axis of the second rail is parallel to the axis of the screw.

14. The outpouring assembly according to claim 12, wherein a location sensor or a stroke switch for determining a moving distance of the outpouring plate is disposed between the outpouring plate and the first valve member.

15. The outpouring assembly according to claim 12, wherein a paste discharge pipe is disposed in the liquid outlet through hole, the paste discharge pipe moves up and down in the liquid outlet through hole, and when a lower end of the paste discharge pipe extends out of the through hole, the paste discharge pipe is in a liquid outpouring state; that the paste discharge pipe moves up and down in the liquid outlet through hole means that the paste discharge pipe is subjected to downward force to extend downwards and is subjected to upward force to retract.

16. The outpouring assembly according to claim 15, further comprising an oscillating rod rotatably disposed on the outpouring plate, wherein an upper limiting stopper and a lower limiting stopper are disposed on the paste discharge pipe, and an end A of the oscillating rod is located between the upper limiting stopper and the lower limiting stopper; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

17. The outpouring assembly according to claim 15, further comprising an oscillating rod rotatably disposed on the outpouring plate, wherein a lower limiting stopper is disposed on the paste discharge pipe, an end A of the oscillating rod is located above the lower limiting stopper, and a spring is disposed between the paste discharge pipe and the outpouring plate; an end B of the oscillating rod is disposed in a horizontal strip-shaped groove of the mounting bracket, and a stroke of horizontal movement of the outpouring plate is greater than a horizontal length of the horizontal strip-shaped groove; a shape of the horizontal strip-shaped groove correspondingly coordinates with an oscillation margin of the oscillating rod.

* * * * *